US006718879B2

(12) United States Patent
Dreher et al.

(10) Patent No.: US 6,718,879 B2
(45) Date of Patent: Apr. 13, 2004

(54) PROCESS AND DEVICE FOR DETERMINING REGISTRATION ERRORS

(75) Inventors: Ingo Klaus Michael Dreher, Kiel (DE); Heiko Hunold, Wattenbek (DE); Patrick Metzler, St. Wendel (DE); Stefan Schrader, Kiel (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/208,216

(22) Filed: Jul. 30, 2002

(65) Prior Publication Data

US 2003/0037689 A1 Feb. 27, 2003

(30) Foreign Application Priority Data

Aug. 22, 2001 (DE) ..... 101 41 035

(51) Int. Cl.[7] ..... B41J 13/08; B41J 13/26
(52) U.S. Cl. ..... 101/485; 400/635
(58) Field of Search ..... 101/483, 484, 101/485; 400/635, 582

(56) References Cited

U.S. PATENT DOCUMENTS 5,875,380 A 2/1999 Iwata et al. ..... 399/301
5,963,240 A * 10/1999 Shinohara et al. ..... 347/116
6,282,396 B1 * 8/2001 Iwata et al. ..... 399/301

FOREIGN PATENT DOCUMENTS

| | | | | |
|---|---|---|---|---|
| DE | 198 06 551 C2 | | 9/2000 | |
| EP | 1005 981 A1 | | 6/2000 | |
| JP | 56025454 A | | 3/1981 | ..... B41F/15/00 |
| JP | 09174942 A | * | 7/1997 | ..... B41J/2/525 |
| JP | 10142895 A | * | 5/1998 | ..... G03G/15/01 |
| JP | 2000272089 A | | 10/2000 | ..... B41F/15/26 |

* cited by examiner

*Primary Examiner*—Daniel J. Colilla
(74) *Attorney, Agent, or Firm*—Lawrence P. Kessler

(57) ABSTRACT

Determining and correcting registration errors, which are caused by the rotational speed of a print cylinder changing because of a sheet passing between the print cylinder and a sheet transport conveyor belt. At least one first registration mark is applied onto the conveyor belt prior to a sheet being transported thereby, and at least one second registration mark is applied onto the conveyor belt after the transported sheet. By the detection of the first registration mark and the second registration mark, a calculation of a timing number between the detection of the first registration mark and the second registration mark can be made. The calculated timing number is compared to a target value to determine any error due to change in angular velocity of the print cylinder due to engagement with the sheet.

2 Claims, 3 Drawing Sheets

PROCESS AND DEVICE FOR DETERMINING REGISTRATION ERRORS

FIELD OF THE INVENTION

The invention involves a process and a printing machine for determining registration errors due to a change in angular velocity of a print cylinder due to engagement with a printing sheet.

BACKGROUND OF THE INVENTION

In the printing of sheets of paper or the like by printing machines, the correctly positioned printing of the printed image on the sheet is of considerable importance. This characteristic is identified by the term registration. In order to set the registration, in addition to the printed image, registration marks are used, by which deviations from correctly positioned print are determined and measured by the operator of the printing machine. In a further embodiment of this process, the registration is determined and calculated using sensors in the printing machine. To do this, the sensors detect the registration marks on a printing sheet conveyor belt or the printing sheet and, using the position of the registration marks, determine whether the printing is being done without errors. The process and devices of the state of the art detect and correct errors that occur due to mechanical shifts of the sheet on the conveyor belt or shifts of the conveyor belt. Further, errors occur which are caused by changing of the rotational speed of a print cylinder because of a sheet running between the print cylinder and the conveyor belt. However, the distances covered, according to which the image is applied to the sheet, are defined by a specific time that passes during the movement of the conveyor belt between a sensor signal, or a signal derived from it, and a print gap or nip in a print module, in which the image is applied onto the sheet. As a result, the printed image is applied in a shifted manner onto the sheet in the print modules. This leads to a registration error.

SUMMARY OF THE INVENTION

The purpose of the invention is thus to determine the registration errors described above. A further purpose of the invention is to correct the errors that are determined. The purposes of the invention are achieved by application by a print cylinder of at least a first registration mark onto a printing sheet transport conveyor belt prior to a sheet transported on such conveyor belt, and application of at least a second registration mark onto such conveyor belt behind the transported sheet. The first registration mark and second registration mark are detected, and a timing number between the detection of the first registration mark and the second registration mark is calculated. The calculated timing number is then compared to a target value to determine any error due to change in angular velocity of a print cylinder due to engagement with the sheet.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
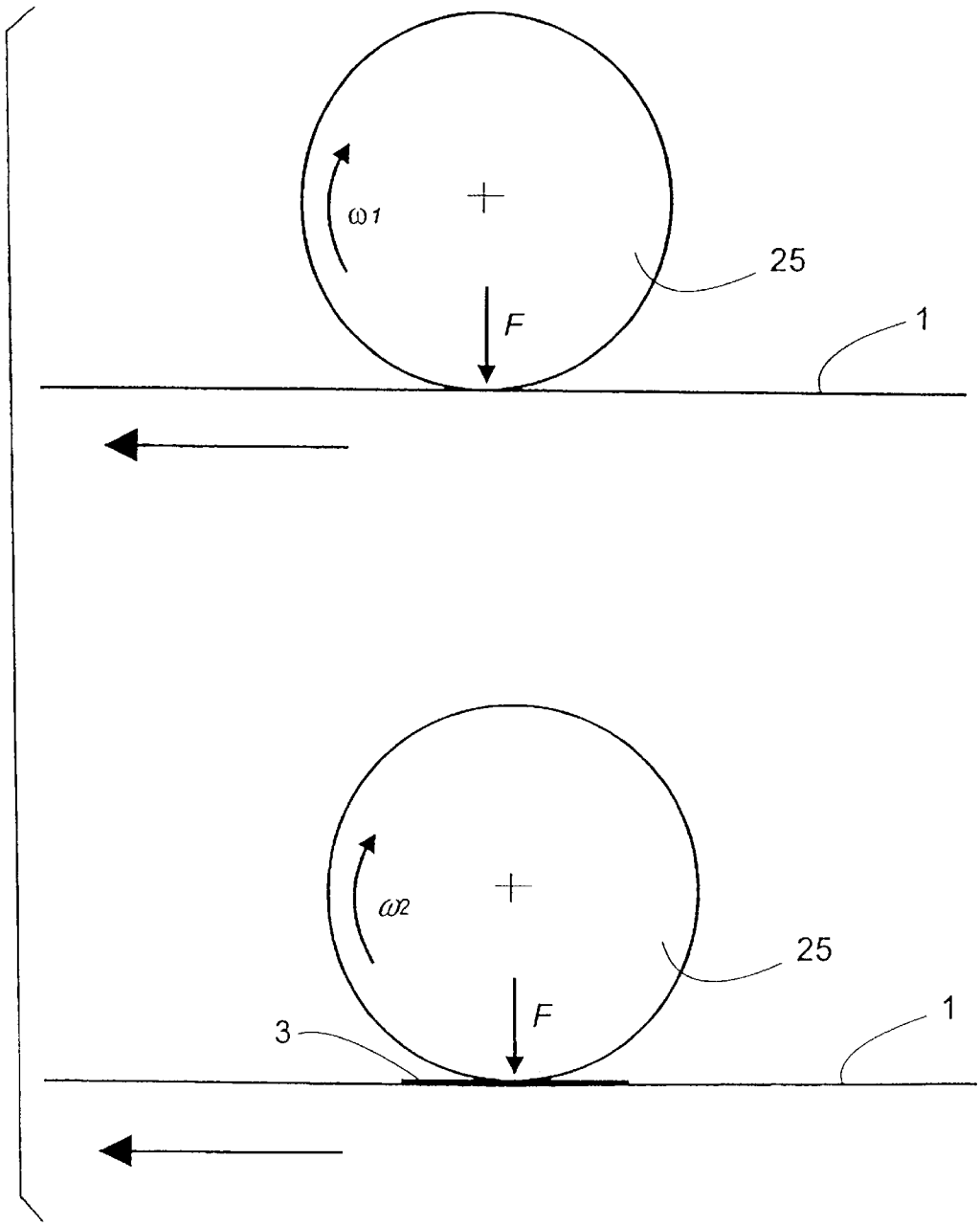
FIG. 1 shows two drawings for describing the registration error, whereby the upper drawing shows a print cylinder on a conveyor belt without the influence of the rotational speed of the print cylinder by a sheet, and the lower drawing shows a print cylinder on a conveyor belt with the influence of the rotational speed of the first cylinder by a sheet.

FIG. 1 shows two drawings for describing the registration error involving the invention. The upper drawing shows a side view of an intermediate cylinder 25 of a printing machine, on which an image is applied by an imaging cylinder 23 (see FIG. 3). The intermediate cylinder 25 moves at the angular velocity $\omega_1$ in the direction of the curved arrow and presses with the force F on the surface of a continuous conveyor belt 1, which moves to the left in the direction of the arrow. In the upper drawing, there are no sheets 3 on the conveyor belt 1. The lower drawing is similar to the upper drawing, except in the lower drawing a sheet 3 of paper is located on the conveyor belt 1 and is held on the conveyor belt 1 by gravity and essentially by electrostatic forces of attraction. The sheet 3 under the intermediate cylinder 25 affects the movement of the intermediate cylinder 25 in such a manner that the speed of the intermediate cylinder 25 changes in comparison with the upper drawing. As can be seen in FIG. 1, the conveyor belt 1 is pressed down in the area of the intermediate cylinder 25 in the lower drawing in comparison with the upper drawing by approximately the length that corresponds the thickness of the sheet 3. The angular velocity of the intermediate cylinder 25 of the lower drawing is now $\omega_2$ in comparison to the upper drawing because of the sheet 3 between the conveyor belt 1 and the intermediate cylinder 25. This change in velocity because of the sheet 3 leads to registration errors during printing, as described in the following in detail.

Figure 2:
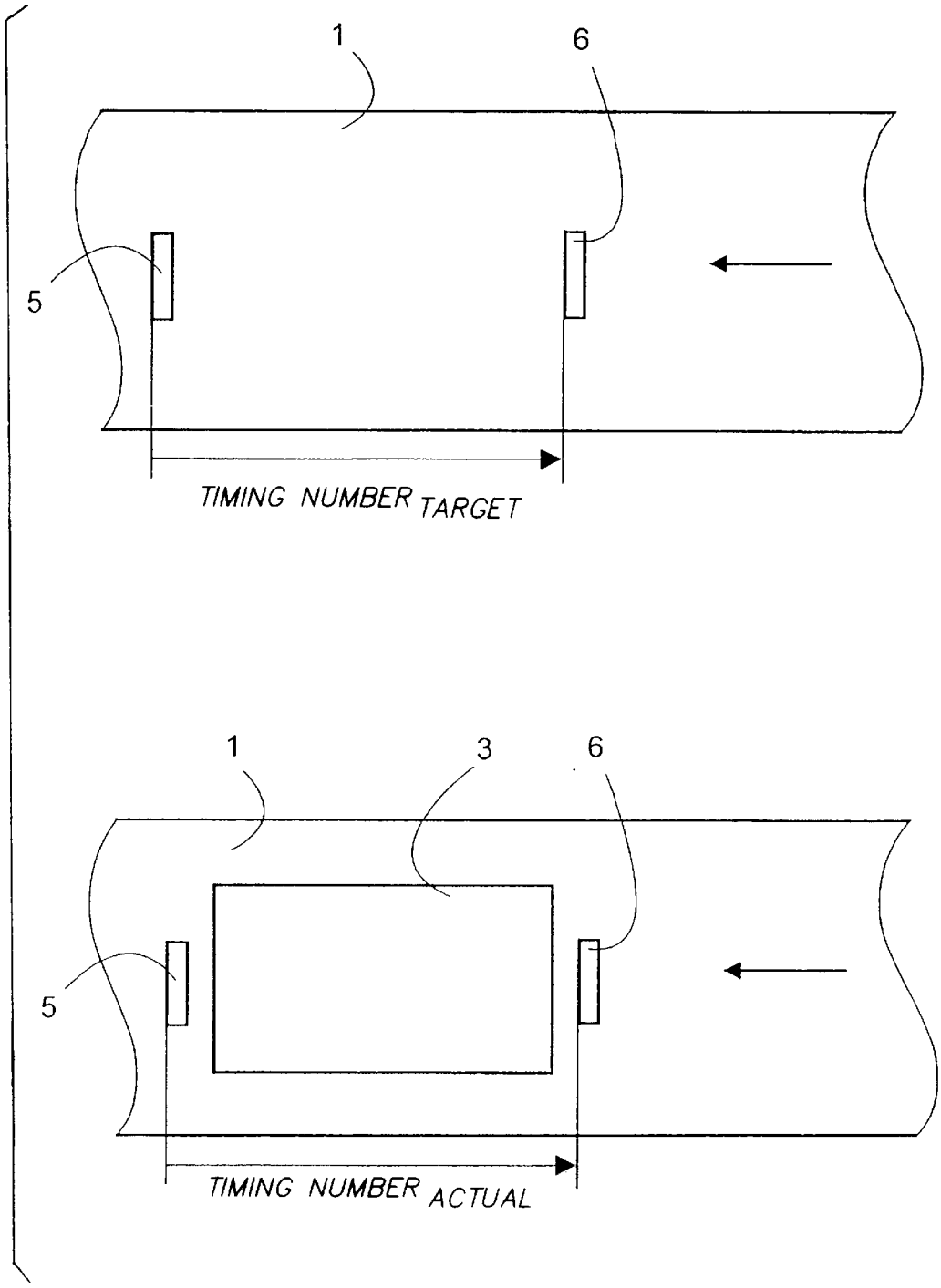
FIG. 2 shows a part of a conveyor belt, whereby a first register mark and a second register mark are applied on the conveyor belt, a sheet being located between such registration marks.

FIG. 2 shows two drawings, each with an overhead view of a section of a conveyor belt 1 that moves in the direction of the arrow. The upper drawing shows, only for reasons of clarification, a first registration mark 5 and a second registration mark 6, whose front edges have a time interval between detection by a second sensor 13 behind the print modules of the printing machine (see FIG. 3). This time interval can be described in a unique manner by a timing number, in this case, timing $\text{number}_{TARGET}$. The lower drawing shows a section of a conveyor belt 1, similar to the one of the upper drawing. In this drawing, the sheet 3 is located on the conveyor belt 1 between the registration marks 5, 6 made on the conveyor belt 1.

As shown in FIG. 1, an intermediate cylinder 25 on the sheet 3 presses on the section of the conveyor belt 1. In this way, as described, the angular velocity of the intermediate cylinder 25 changes from $\omega_1$ to $\omega_2$. The sheet 3 exerts a brake effect on the movement of the intermediate cylinder 25 on the conveyor belt 1. Between the intermediate cylinder 25 and the conveyor belt 1, there is friction. If the intermediate cylinder 25 again acts directly on the conveyor belt 1 and not on the sheet 3 after the sheet 3 passes through, the velocity $\omega_1$ again becomes set on the intermediate cylinder 25, until another sheet 3 is conveyed under the intermediate cylinder 25, onto which an additional image is applied by the intermediate cylinder 25.

As can be easily understood, the change in velocity of the intermediate cylinder 25 with engagement with sheet 3 leads to errors during the transfer of the image from the intermediate cylinder 25 onto the sheet 3, since the ratio of the speeds of the conveyor belt 1 and the angular velocity of the intermediate cylinder 25 changes, whereby the constancy of this ratio is essential for the registered application of the image onto the sheet 3. As a solution, using an arrangement of the lower drawing of FIG. 2, a calibration run is performed to determine the registration error. The first sensor 12 (see FIG. 3) detects first the front edge of the first registration mark 5 and after that, the front edge of the second registration mark 6, corresponding to the upper drawing according to FIG. 2. The timing number between the detection of the front edges of the registration marks 5,6 is, in this case, however, not timing $number_{TARGET}$, but deviates by an amount by which the second registration mark 6 is applied later onto the sheet 3 because of the effect described above. In fact, in the lower drawing according to FIG. 2, a time passes, between the detection of the front edge of the first registration mark 5 and the front edge of the second registration mark 6, which can be assigned a timing number timing $number_{ACTUAL}$, which is larger than the timing number timing $number_{TARGET}$. By knowledge of and formation of the difference between timing $number_{ACTUAL}$ and timing $number_{TARGET}$, the timing difference timing $number_{DIFF}$ can be determined. Timing $number_{DIFF}$ describes the timing number that is counted more by the effect of the sheet 3 between the detection of the front edges of the registration marks 5, 6 than without the sheet 3. As a result, using timing $number_{DIFF}$, the effect of the sheet 3 on the registration of the image to be printed on the sheet 3 can be quantified and corrected with suitable mechanisms.

Figure 3:
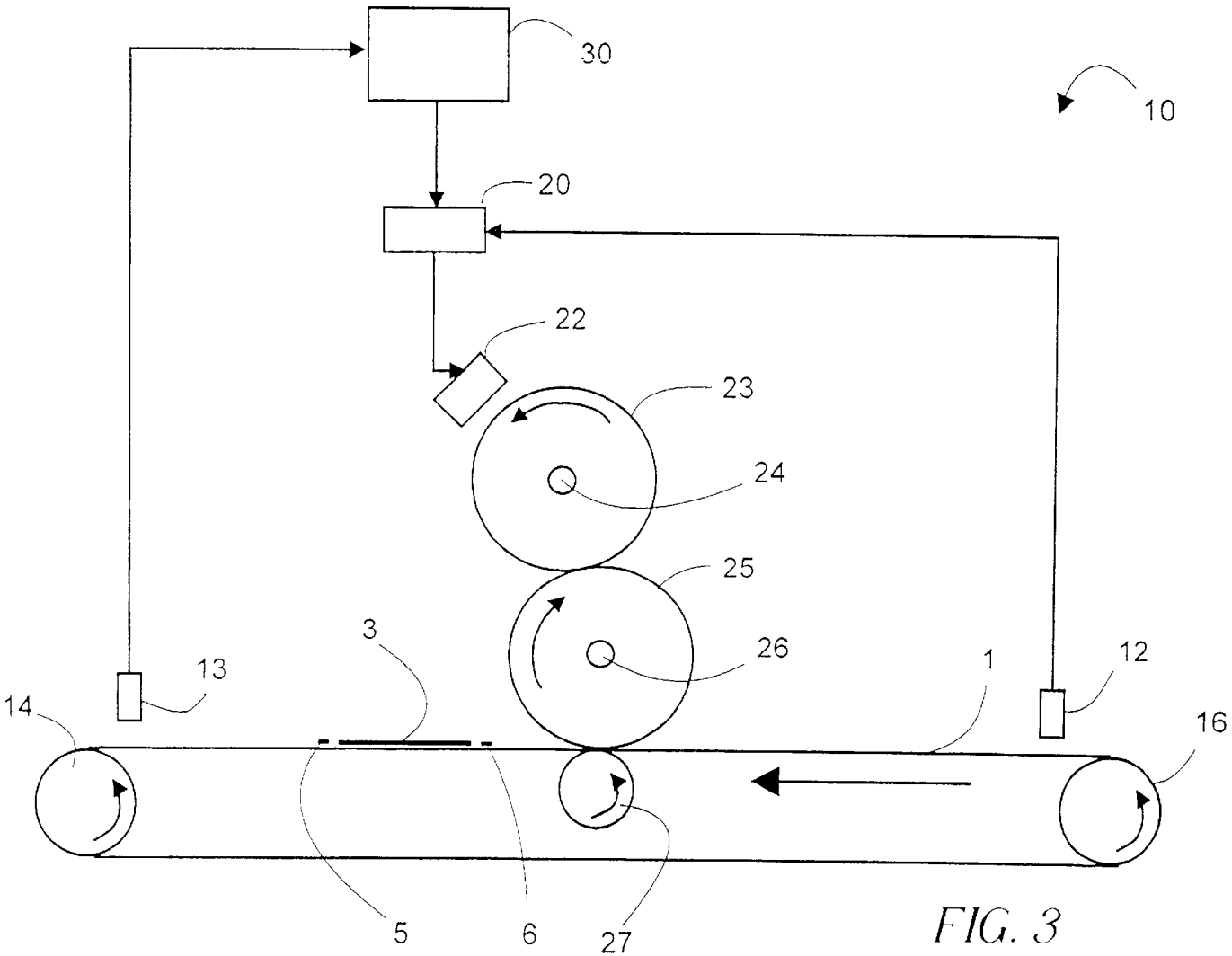
FIG. 3 shows a device with a part of a print module involving the invention.

FIG. 3 shows a schematic side view of a device 10 with a part of a print module of a printing machine above the conveyor belt 1. Usually, the printing machine has several print modules, a print module for each ink (color), whereby the individual inks combine into an overall image. The conveyor belt 1 is driven by the drive on the deflection rollers 14, 16 and moves in the direction of the arrow. The first deflection roller 16, the second deflection roller 14, a press-on roller 27 for providing a counter-force to the press-on force of the intermediate cylinder 25, the intermediate cylinder 25, and the imaging cylinder 23 move in the directions shown in FIG. 3.

The imaging cylinder 23 and the intermediate cylinder 25 have a first encoder 24 and/or a second encoder 26, which detect a specific angular velocity of the imaging cylinder 23 and/or the intermediate cylinder 25, so that the rotating angle is known at any point in time. A first sensor 12 at the beginning of the conveyor belt 1 detects the front edge of the sheet 3 and transmits a signal to a timing counter 20 in response to such front edge detection. As a result of this signal, an additional signal is generated which triggers the imaging of the imaging cylinder 23 using an imaging device 22. The additional signal is made at exactly a point in time that the image transferred onto the imaging cylinder 23 rolls off on the intermediate cylinder 25 and is transferred from it exactly at the correct position on the sheet 3. This is possible by knowledge of the velocity of the conveyor belt 1 with the sheet 3 and the distance of the first sensor 12 and the sensor signal generated by it from the transfer position of the image between the intermediate cylinder 25 and the sheet 3 (i.e., the print gap or nip).

The time difference between the additional signal and the application of the image, which is caused by the additional signal, is hereby defined as a delay time, to which a delay value is assigned in a unique way, shown as a timing number. In the case presented, of a calibration run according to FIG. 3, the first registration mark 5 is, as described above, printed by the intermediate cylinder 25 onto the conveyor belt 1. The printing is done in such a way that a sheet 3 follows the first registration mark 5 on the transport conveyor 1. Next, the intermediate cylinder 25 of the print module applies the second registration mark 6 on the conveyor belt 1. As a result, on the conveyor belt 1, an arrangement is produced according to the lower drawing according to FIG. 2.

The second sensor 13 on the end of the print module detects the front edge of the first registration mark 5 and the front edge of the second registration mark 6. The sensor 13 transfers signals to a correction device 30, which start the timing counter 20 upon detection of the front edge of the first registration mark 5 and stop the timing counter 20 upon detection of the front edge of the second registration mark 6. In this way, a timing $number_{ACTUAL}$ is obtained, which refers to the distance of the front edge of the first registration mark 5 from the front edge of the second registration mark 6 and can be converted into this distance using the velocity of the conveyor belt 1. The timing $number_{ACTUAL}$ can be assigned to the time, which passes from detection of the front edge of the first registration mark 5 until the detection of the front edge of the second registration mark 6, since a timing number can be assigned a time in a unique manner. The timing $number_{ACTUAL}$ is different from the timing $number_{TARGET}$ for the reason that the sheet 3 causes a change of the angular velocity of the intermediate cylinder 25 in relation to the conveyor belt 1 when it passes through the nip between the intermediate cylinder 25 and the conveyor belt 1. This effect cannot be determined for the first registration mark 5, since it is detected before the sheet 3, as can be seen in FIG. 3. Upon the detection of the second registration mark 6 behind the sheet 3, the effect can be determined, however, in that the timing $number_{DIFF}$ is formed from the detected timing $number_{ACTUAL}$ and a saved timing $number_{TARGET}$. The timing $number_{DIFF}$ describes in a unique way the registration error caused by the above effect.

The described calibration run can be performed several times, in order to increase the sensitivity during detection of the registration error. For this purpose, the timing $number_{DIFF}$ is calculated. In the correction device 30, the delay value shown as a timing number is changed by the timing $number_{DIFF}$. Then a corrected delay value is present, which takes into account the registration error described above. During printing following the calibration run, the corrected delay value is used. As a result, the imaging device 22 begins with the transfer of the corresponding image at another point in time than without the calibration run described above. The term "image" describes, in relation to this invention, image lines, image sections and images of individual color separations of the print modules, which combine to form an overall image. The above description contains examples with sheets 3. The invention extends, however, to all types of non-continuous printed material and is not limited to sheets.

The invention has been described in detail with particular reference to certain preferred embodiments thereof, but it will be understood that variations and modifications can be effected within the spirit and scope of the invention.

What is claimed is:

1. Process for determining registration errors during printing, which are caused by a change in the speed of a print cylinder, because of engagement with a sheet (3), comprising:

applying by said print cylinder at least a first registration mark (5) onto a printing sheet transport conveyor belt (1) prior to a sheet (3) transported on such conveyor belt; applying at least a second registration mark (6) onto such conveyor belt (1) behind the transported sheet (3); detecting the first registration mark (5) and detecting the second registration mark (6); calculating a timing number between the detection of the first registration mark (5) and the detecting of the second registration mark (6); and comparing the calculated timing number to a target value.

2. Process according to claim 1, further comprising detecting a transported sheet (3) by a first sensor (12) prior to printing, and generating a start signal upon detection of the sheet (3) by said first sensor for starting a timing counter (20); applying registration marks (5, 6); and detecting the registration marks (5, 6) by a second sensor (13) after printing, and generating a stop signal by said second sensor for stopping the timing counter (20).

* * * * *